US006726183B2

(12) United States Patent
Wiley

(10) Patent No.: US 6,726,183 B2
(45) Date of Patent: Apr. 27, 2004

(54) FENCE SYSTEM

(75) Inventor: Gary W. Wiley, Corinth, TX (US)

(73) Assignee: Wiley Built, LLC, Corinth, TX (US)

( * ) Notice: Subject to any disclaimer, the term of this patent is extended or adjusted under 35 U.S.C. 154(b) by 19 days.

(21) Appl. No.: 10/120,871

(22) Filed: Apr. 12, 2002

(65) Prior Publication Data

US 2003/0193047 A1 Oct. 16, 2003

(51) Int. Cl.[7] ..... A47B 95/00
(52) U.S. Cl. ..... 256/24; 256/59; 256/45.01
(58) Field of Search ..... 256/24, 19, 25, 256/26, 59, 65.01

(56) References Cited

U.S. PATENT DOCUMENTS 5,531,427 A * 7/1996 Quarles ..... 256/22
5,904,343 A * 5/1999 Parth ..... 256/24
6,036,156 A * 3/2000 Collette et al. ..... 256/59 X
6,260,828 B1 * 7/2001 English ..... 256/24

* cited by examiner

*Primary Examiner*—John R. Cottingham
(74) *Attorney, Agent, or Firm*—John E. Vandigriff, LLC

(57) ABSTRACT

A fencing system includes fencing panels that are made of first and second parts jointed together at both edges extending the length of each part. Each part has a U-shaped slot along one edge and another of said edges has an extended ridge, wherein in securing the two parts together, the extended ridge of each part is inserted into the U-shaped slot of the other part. The panels may be mounted vertically or horizontally between two U-shaped rails, extending horizontally, and secured between two fence posts. When the panels are mounted vertically, a panel may be mounted over a fence post, the post extend upward in the panel in a space formed by the two parts of the panel.

14 Claims, 5 Drawing Sheets

FENCE SYSTEM

FIELD OF THE INVENTION

The invention relates to a modular fence system which includes fence planks designed for insertion into open channels, and more particularly to a fence system that has panels including two separate face panels that join together to form a single panel which may be placed vertically or horizontally between fence posts.

BACKGROUND OF THE INVENTION

Modular fence systems have been used utilizing fence panels that are inserted into channels. U.S. Pat. No. 5,988,599, describes a modular fence system that includes fence planks designed for insertion into open channels of upper and lower fence rails. The fence planks are molded, one piece, planks. The fence rails are supported in a horizontal orientation between intermittent fence posts, with the fence planks extending vertically between the rails. The planks include resilient protrusions at their upper ends. The protrusions of the planks are designed to fit into internal passages formed in the open channels of the upper fence rail, into engagement with ledges defining the passages, to inhibit inadvertent removal of the planks from the upper rail.

U.S. Pat. No. 6,345,809, defines a fence panel that has hollow planks or panels that are generally rectangular in shape. The panels are connected by hooked extension on each end of the panel that connected in slots in the fence posts.

U.S. Pat. No. 6,041,486, defines a modular fence system which includes fence planks designed for insertion into open channels of upper and lower fence rails. The fence rails are supported in a horizontal orientation between intermittent fence posts, with the fence planks extending vertically between the rails. The planks include resilient protrusions at their upper ends. The protrusions of the planks are designed to fit into internal passages formed in the open channels of the upper fence rail, into engagement with ledges.

SUMMARY OF THE INVENTION

The invention is to a fencing system that includes fencing panels that are made of first and second parts jointed together at the edges. Each of said first and second parts has two edges, one of said edges has a U-shaped slot and another of said edges has an extended ridge, wherein in securing the two parts together, the extended ridge of each part is inserted into the U-shaped slot of the other part. The panels may be mounted vertically between two U-shaped rail, and the rails extending horizontally and secured between two fence posts. The panels may also be mounted horizontally between and secured to two fence posts. When the panels are mounted vertically, a panel may be mounted over a fence post, the post extending upward in the panel in a space formed by the two parts of the panel.

BRIEF DESCRIPTIONS OF THE DRAWINGS

DESCRIPTION OF A PREFERRED EMBODIMENT

Figure 1:
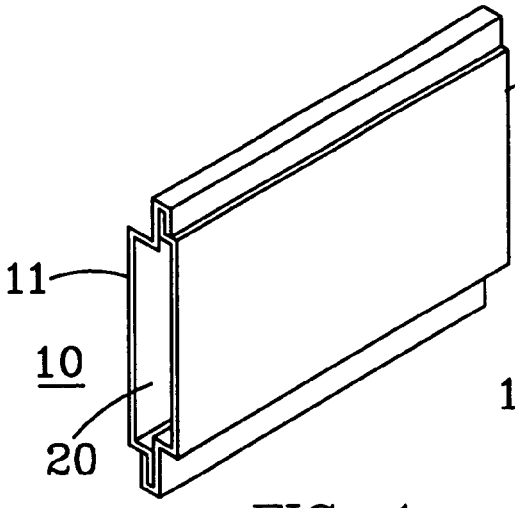
FIG. 1 is an isometric view of an assembled fend panel.
Figure 2:
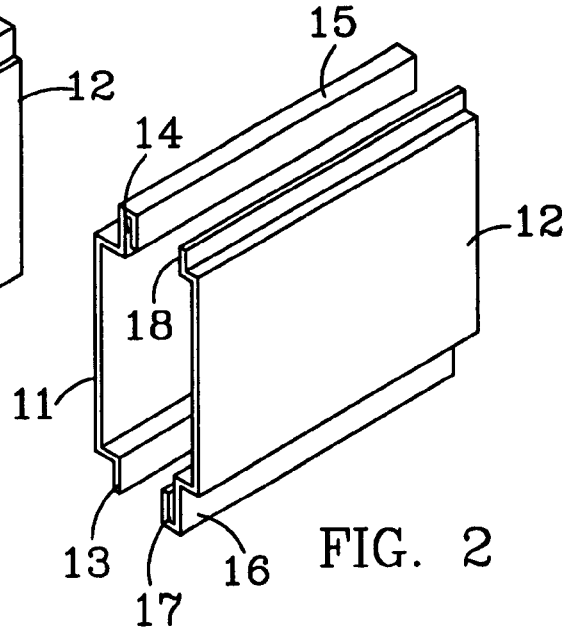
FIG. 2 illustrates the two parts of the panel of FIG. 1.

FIG. 1 shows a fence panel 10 according to the present invention. The panel consists of two joined parts 11 and 12 that interlock with each other. FIG. 1 shows the interlocked parts 11 and 12. FIG. 2 shows the two parts 11 and 12 separated. Part 11 has a U-shaped slot 14 on the top edge 15 and a extending ridge 13 on the bottom edge. Part 12 is similar to part 1, but part 12 has a extending ridge 18 on the top edge and a U-shaped slot 17 on the bottom edge 16. In joining the two parts 11 and 12 to form panel 10, the extending edge 13 of part 11 is placed in slot 19 of part 12 and extending edge 18 of part 12 is placed in slot 14 of part 11. The two parts 11 and 12 are easily joined by positioning part 11 slightly above part 12, moving the two parts together, and then lowering part 11 so that edge 18 enters slot 14 and edge 13 enters slot 17.

Figure 3:
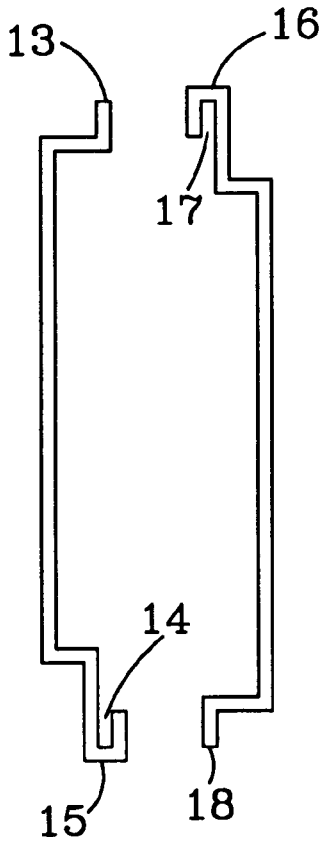
FIG. 3 is an end view of the two parts of the fence panel.
Figure 4:
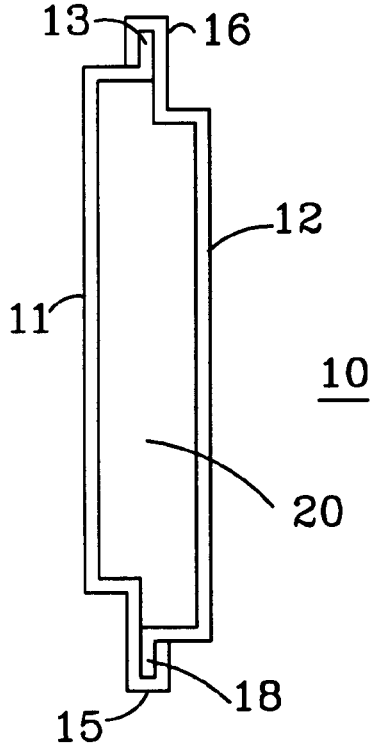
FIG. 4 is an end view of the assembled fence panel parts'

FIG. 3 shows and end view of panel parts 11 and 12 before they joined. The two parts are identical, with one part inverted from the other. FIG. 4 shows the two parts 11 and 12 jointed together. In assembling parts 11 and 12 together, for example, part 12 (FIG. 4) may be attached to a fence post (See FIG. 5 below) and then part 11 is jointed to part 12 by placing part 11 slightly above part 12 and then sliding part 11 downward so that U-slot 14 slides down over edge 18, and edge 13 slides into U-slot 17 on part 12, securing parts 11 and 12 together forming panel 10. It should be noted that when parts 11 and 12 are joined together, there is an opening 20 extend along the length of panel 10.

Figure 5:
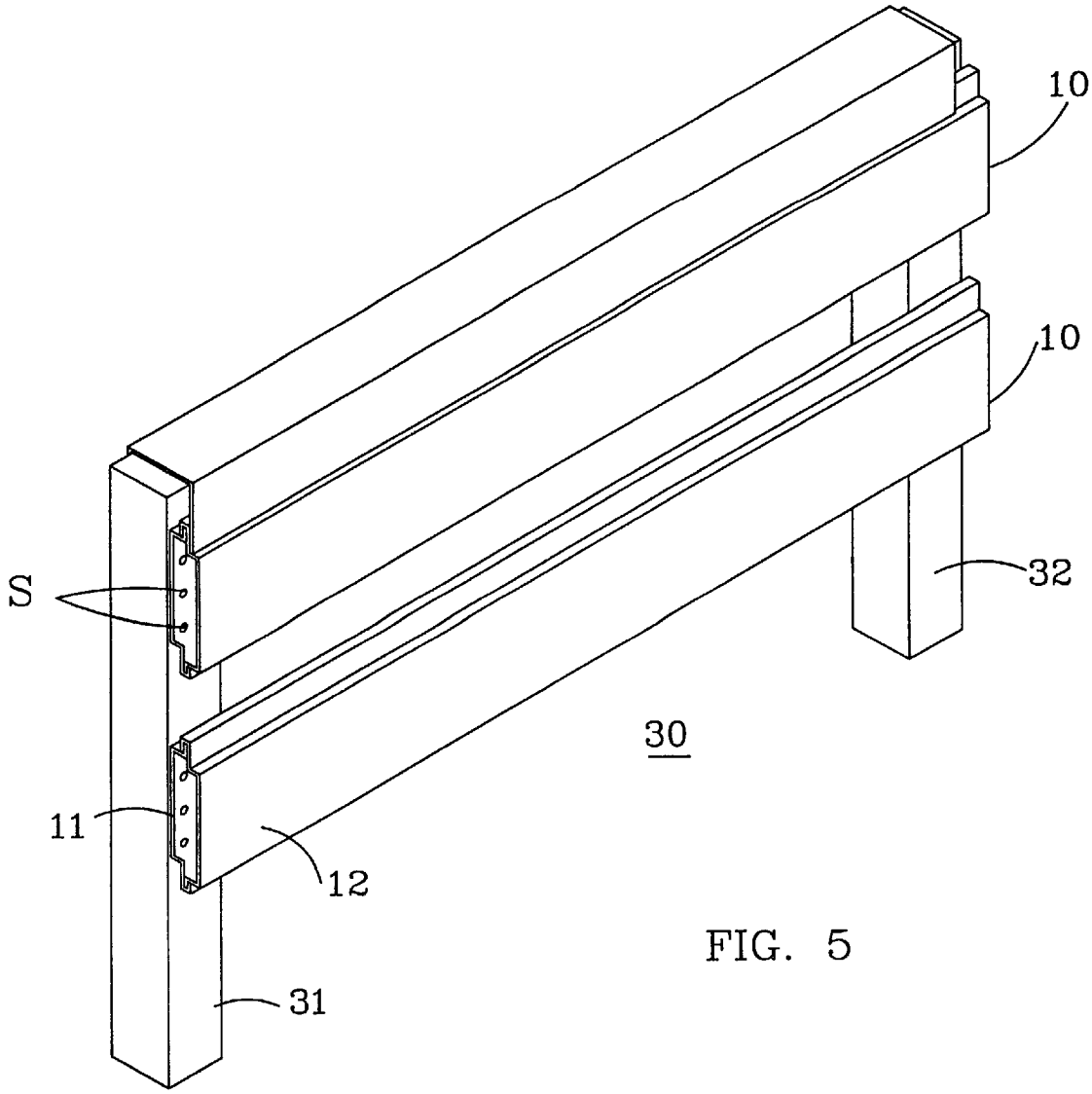
FIG. 5 show a fence utilizing the fence panel.

FIG. 5 illustrates an example of a fence using fence panel 10. A plurality of panels are mounted between two fence posts 31 and 32. Panels 10 may be spaced apart or the lower edge of one panel may be placed over the upper edge of the panel below it. Part 11 is attached to the post by screws or nails, then part 12 is attached to part 11 as described with reference to FIGS. 3 and 4. The over lapping of panels allows for privacy fencing. A top U-shape 33 beam may be placed over the top of the fence posts and over the top edge of the top panel 10. Part 11, of panel 10, may be secured to posts 31 and 32 by screws S before part 12 is joined to part 11.

Figure 6:
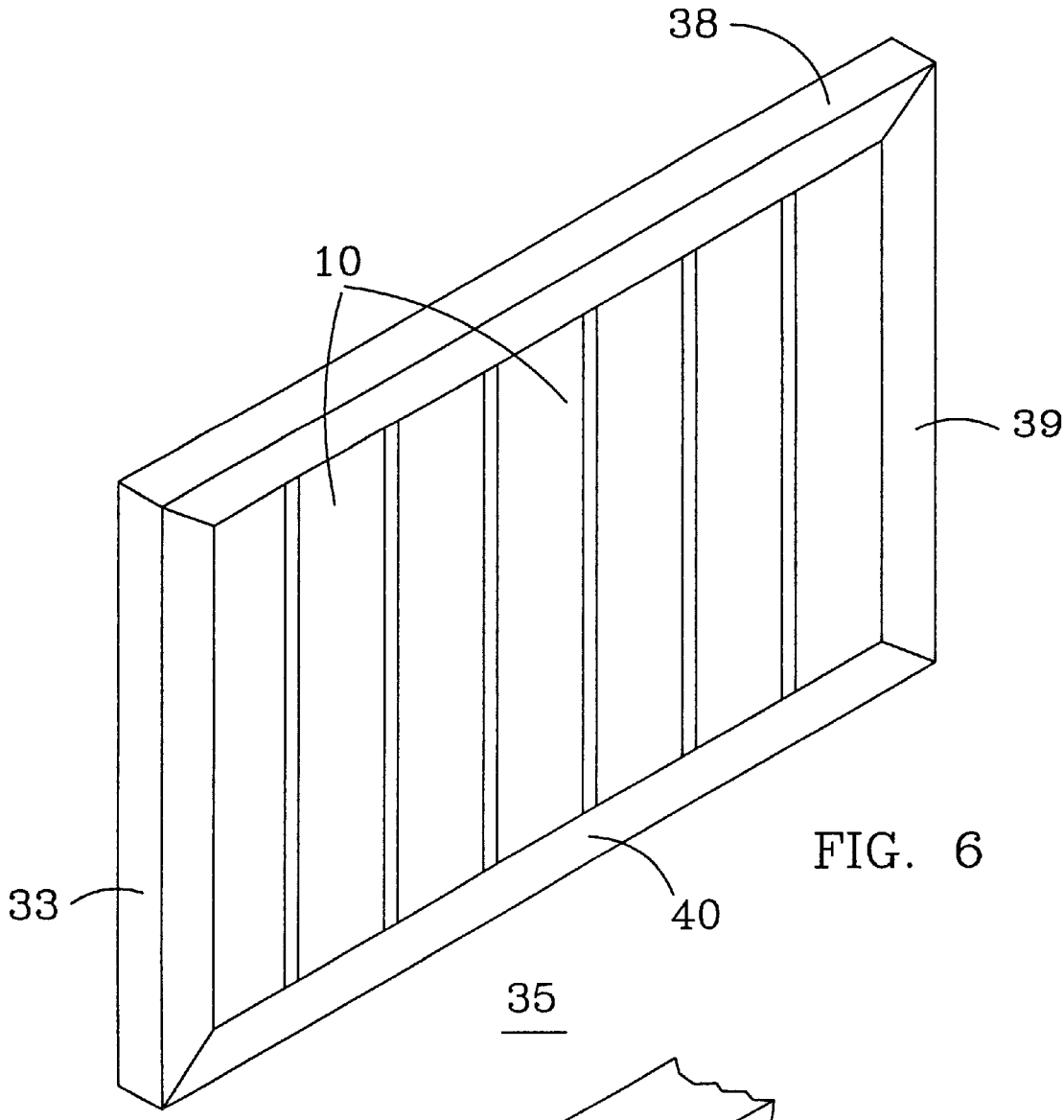
FIG. 6 shows fence with the panels mounted vertically.
Figure 7:
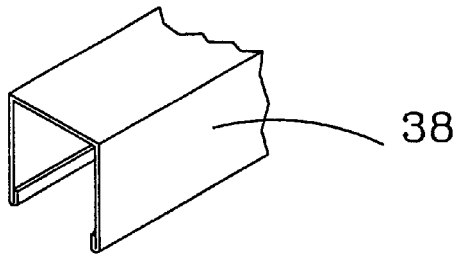
FIG. 7 shows a portion of a rail used in the fence assembly.

FIG. 6 show another fence example for mounting panels 10 for forming the fence. A plurality of fence panels 10 are place in U-shaped channels 38 and 40. The panels are then enclosed by vertical U-shaped channels 33 and 39. The combination of U-shaped channels 37, 38, 39 and 40, enclosing panels 10, forms a fence panel that is mounted between two posts. FIG. 7 shows a portion of a U-shaped channel 38.

Figure 8:
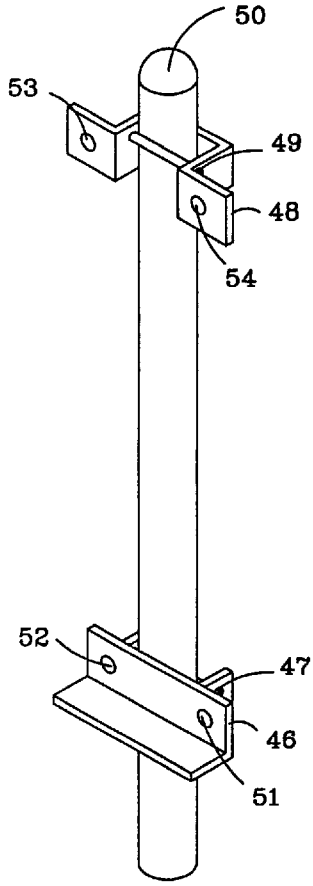
FIG. 8 shows one method of mounting a fence panel to a post.

FIG. 8 shows a fence post 50 with a lower mounting bracket 46 and an upper mounting bracket 48. A fence panel such a panel 35, FIG. 6, is placed on bottom bracket 46 and secured thereto by screws, not illustrated, extending through holes 51 and 52. The top of the panel is secured by screws (not illustrated) extending through holes 53 and 54 in upper bracket 48. Upper bracket 48 is secured to post 50 by bolt 49, and lower bracket 46 is secured to post 50 by bolt 47.

Figure 9:
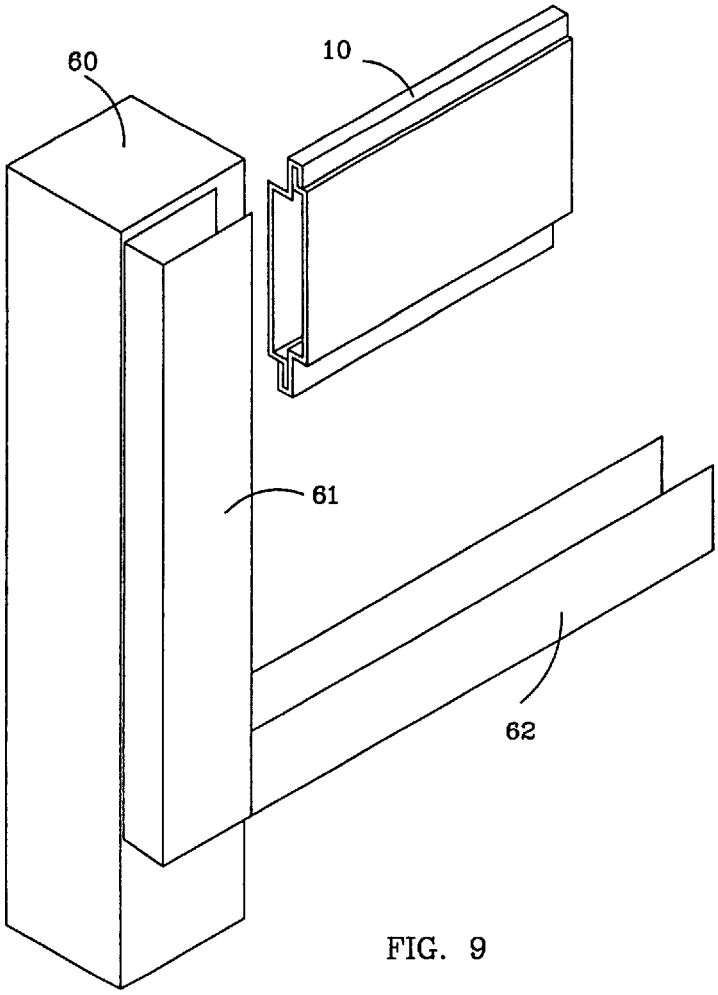
FIG. 9 shows a second method of mounting fence panels.

FIG. 9 illustrates a post 60 with an end bracket 61. In this embodiment, panels 10 are placed between two post, each post having a bracket 61 into which panels are placed.

Panels 10 are supported on the bottom by channel 62. This fence/panel configuration is similar to that of FIG. 6, except the panels in FIG. 9 are horizontally mounted.

Figure 10:
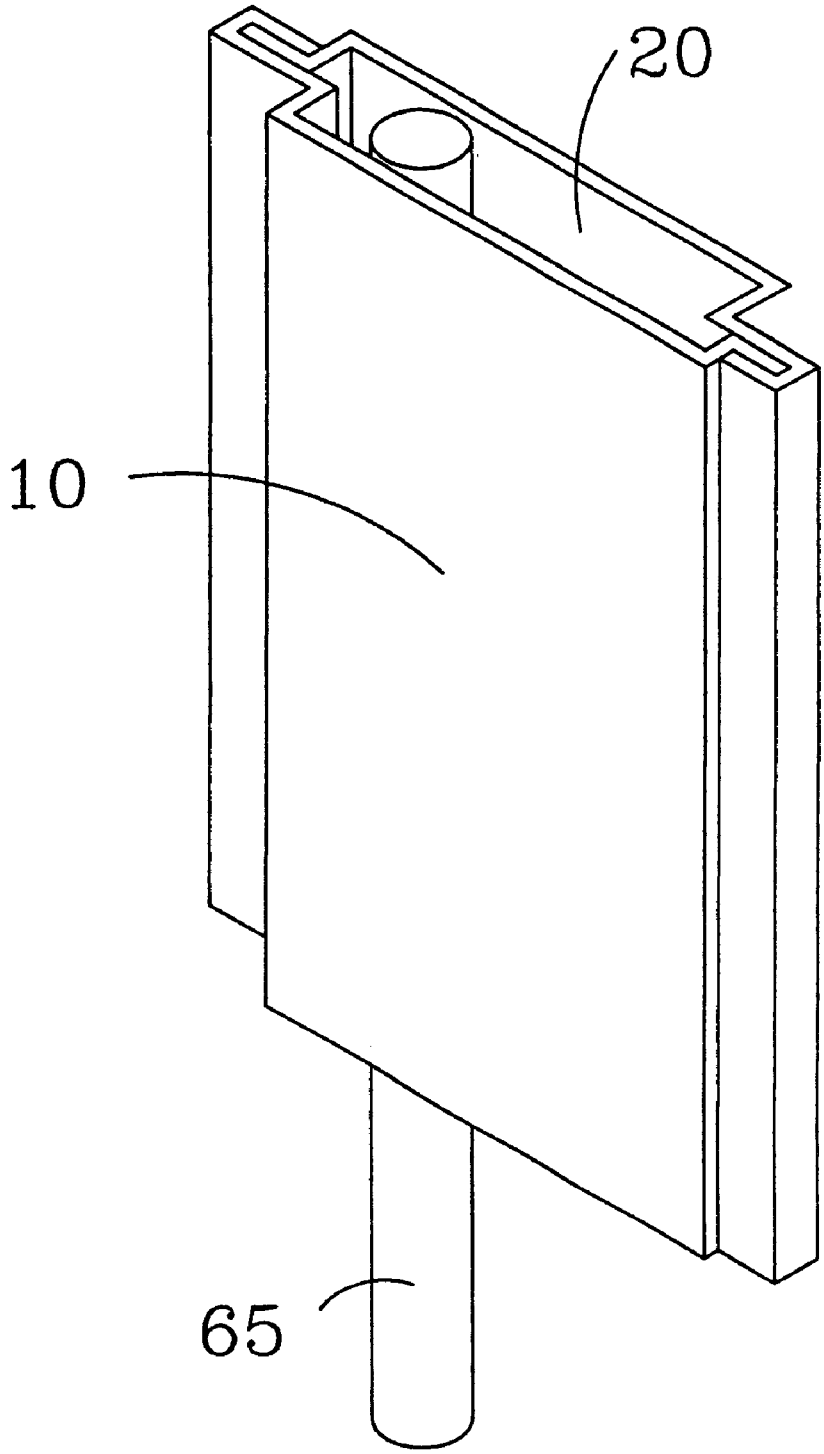
FIG. 10 shows mounting a fence over a fence post.

FIG. 10 illustrate a fence assembly in which the panel 10 is placed over the fence post 65. The bottom of the panels are mounted on a bottom rail, such as rail 62 in FIG. 9. The assembly of FIG. 10 can be used with existing or new fence posts. Since the opening 20 is elongated, the panel may be moved to adjust for width of panels and spacing of the fence posts.

What is claimed is:

1. A fence system, comprising at least two fence posts;

a plurality of panels mounted between two fence posts, each of said panels including a first part and a second part, said first and second parts secured together along two edges of each part extending the length of each first and second part forming said panel having an enclosed area between said joined first and second parts, wherein one of said two edges of each part has a U-shaped slot and another of said edges has an extended ridge, wherein in securing the two parts together, the extended ridge of each part is inserted into the U-shaped slot of the other part forming the enclosed area of said panel.

2. The fence system according to claim 1, including upper and lower rails mounted between two posts, and a plurality of said panels mounted vertically between said upper and lower rail.

3. The fence system according to claim 1, wherein a plurality of panels are mounted horizontally between and secured to the posts.

4. The fence system according to claim 1, wherein a plurality of panels are mounted, partially overlapping an adjacent panel, said plurality of panels mounted in U-shaped rails, at least two of said rails extending between and attached to fence posts.

5. The fence system according to claim 4, wherein four of the U-shaped rails form a frame, and a plurality of panels are mounted one of vertically and horizontally within the frame to form a fence section that is mounted to two fence posts.

6. The fence system according to claim 1, wherein said first and second parts, when joined together, form a central enclosed area extending the length of the panel.

7. The fence system according to claim 6, wherein a panel is mounted over each fence post, said post extending vertically upward through the central opening in a panel.

8. A fence system, comprising at least two fence posts;

a plurality of panels mounted between two fence posts, each of said panels including a first part and a second part, each of said first and second parts has two edges, one of said edges has a U-shaped slot and another of said edges has an extended ridge, wherein in securing the two parts together, the extended ridge of each part is inserted into the U-shaped slot of the other part forming said panel having an enclosed area between said joined first and second parts.

9. The fence system according to claim 8, including upper and lower rails mounted between two posts, and a plurality of said panels mounted vertically between said upper and lower rail.

10. The fence system according to claim 8, wherein a plurality of panels are mounted horizontally between and secured to the posts.

11. The fence system according to claim 8, wherein a plurality of panels are mounted, partially overlapping an adjacent panel, said plurality of panels mounted in U-shaped rails, at least two of said rails extending between and attached to fence posts.

12. The fence system according to claim 11, wherein four of the U-shaped rails form a frame, and a plurality of panels are mounted one of vertically and horizontally within the frame to form a fence section that is mounted to two fence posts.

13. The fence system according to claim 8, wherein said first and second parts, when joined together, form a central enclosed area extending the length of the panel.

14. The fence system according to claim 13, wherein a panel is mounted over each fence post, said post extending vertically upward through the enclosed area extending the length of the panel.

* * * * *